US006749492B2

(12) United States Patent
Chiang

(10) Patent No.: US 6,749,492 B2
(45) Date of Patent: Jun. 15, 2004

(54) ROTARY SANDING MACHINE WITH A DUST COLLECTING MECHANISM

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/373,263

(22) Filed: Feb. 21, 2003

(65) Prior Publication Data

US 2004/0092214 A1 May 13, 2004

(30) Foreign Application Priority Data

Nov. 11, 2002 (TW) ..... 91218065 U

(51) Int. Cl.[7] ..... B24B 1/00

(52) U.S. Cl. ..... 451/296; 451/297; 451/299; 451/336; 451/337; 451/451; 451/453

(58) Field of Search ..... 451/296, 297, 451/299, 336, 337, 451, 453

(56) References Cited

U.S. PATENT DOCUMENTS 3,889,429 A * 6/1975 Zuercher ..... 451/296
4,221,081 A * 9/1980 Everett ..... 451/296
6,001,004 A * 12/1999 Botteghi ..... 451/168

* cited by examiner

*Primary Examiner*—Lee D. Wilson
*Assistant Examiner*—Shantese McDonald
(74) *Attorney, Agent, or Firm*—Trop, Pruner & Hu, P.C.

(57) ABSTRACT

A rotary sanding machine includes a driven wheel coupled to a transmission shaft which is driven by a motor so as to actuate an emery coated belt for sanding. A barrier wall is disposed to hold back dust flying during sanding action to permit the dust to fall into a dust passageway in a dust collecting member. An impeller is mounted in a blower casing, and is coupled to an impeller driving shaft which is rotated with the transmission shaft by means of an endless drive transmission member such that the dust falling in the dust passageway can be drawn into the blower casing for discharge through a discharge port.

5 Claims, 14 Drawing Sheets

ROTARY SANDING MACHINE WITH A DUST COLLECTING MECHANISM

CROSS-REFERENCE TO RELATED APPLICATION

This application claims priority of Taiwanese Application No. 091218065, filed on Nov. 11, 2002.

BACKGROUND OF THE INVENTION

1. Field of the Invention

This invention relates to a rotary sanding machine, more particularly to a rotary sanding machine with a dust collecting mechanism which is driven by a motor thereof.

2. Description of the Related Art

Referring to FIGS. 1 to 3, a conventional rotary sanding machine 10 is shown to include a support frame 11 that has two side frame walls 111,112, a transverse wall 113 disposed between the side walls 111,112, and an upright wall 114 extending upwardly from the transverse wall 113 and spaced apart from the side frame wall 111. A power unit 12 includes a motor 121 which is mounted between the side frame walls 111,112 under the transverse wall 113, a driving pulley 122 which is driven by an output shaft (not shown) of the motor 121, and a driven pulley 123 which is rotated with the driving pulley 122 by means of an endless belt 124 such that a transmission shaft (not shown) that is coaxially coupled with the driven pulley 123 is rotated.

A sanding member 13 is mounted on the transverse wall 113, and includes two spaced apart side plates 131,132, a driven wheel 134 which is mounted between the side plates 131,132, a follower wheel 133 which is opposite to the driven wheel 134, and an emery coated belt 135 which is trained on the driven and follower wheels 134,133. The driven wheel 134 is coupled to and is rotated by the transmission shaft so as to rotate the belt 135 along a running route for sanding a workpiece (not shown) thereon. Since a large amount of dust is generated and scattered during the sanding operation, collecting means is needed to collect the dust.

SUMMARY OF THE INVENTION

The object of the present invention is to provide a rotary sanding machine which has a dust collecting mechanism to collect dust during a sanding operation.

According to this invention, the rotary sanding machine includes a support frame which has right and left frame walls opposite to each other in a longitudinal direction to confine a receiving space, and a mounting wall disposed between the frame walls and extending in the longitudinal direction. The mounting wall has a through hole which extends therethrough in an upright direction. A motor has an output shaft to deliver a drive force.

A transmission shaft extends along and is rotatable about a first axis in the longitudinal direction, and is driven by the drive force of the output shaft. The transmission shaft has a first transmission shaft end above the mounting wall, a second transmission shaft end disposed on the right frame wall, and a middle transmission shaft portion disposed between the shaft ends.

A sanding member includes a driven wheel which is mounted above the mounting wall, which is spaced apart from the through hole in a transverse direction relative to the upright and longitudinal directions, and which is coupled to and rotated by the first transmission shaft end, a follower wheel opposite to the driven wheel in the transverse direction to define an upper path for passage of a workpiece, and an emery coated belt which is trained on the driven and follower wheels. The emery coated belt has a working segment running through the upper path for sanding the workpiece.

A barrier wall extends upwardly from the mounting wall, and is disposed opposite to the driven wheel relative to the through hole so as to hold back dust flying as a result of the sanding action and an abrupt descending movement of the working segment to permit the dust to fall into the through hole.

A dust collecting member is mounted on the mounting wall and under the through hole. The dust collecting member has a dust passageway which has an intake port disposed in the vicinity of the through hole to collect dust falling through the through hole, and an outlet port.

A blower casing is disposed in the receiving space, and has proximate and distal walls opposite to each other in the longitudinal direction and respectively proximate to and distal from the outlet port of the dust passageway to confine a casing space, and a discharge port which is disposed between the proximate and distal walls and which is in fluid communication with the casing space. The proximate wall has an inlet port which is connected to the outlet port so as to communicate the dust passageway with the casing space.

An impeller driving shaft is mounted rotatably on the distal wall about a second axis parallel to the first axis, and has a first end which extends into the casing space, and a second end which extends from the first end and outwardly of the distal wall.

An endless drive transmission member is disposed to transmit the drive force of the output shaft to rotate both the transmission shaft about the first axis, and the second end of the impeller driving shaft, thereby rotating the impeller driving shaft about the second axis when the motor is operated.

An impeller is received in the casing space, and is driven by the first end of the impeller driving shaft to rotate about the second axis so as to draw the dust from the dust passageway into the casing space for discharge through the discharge port.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
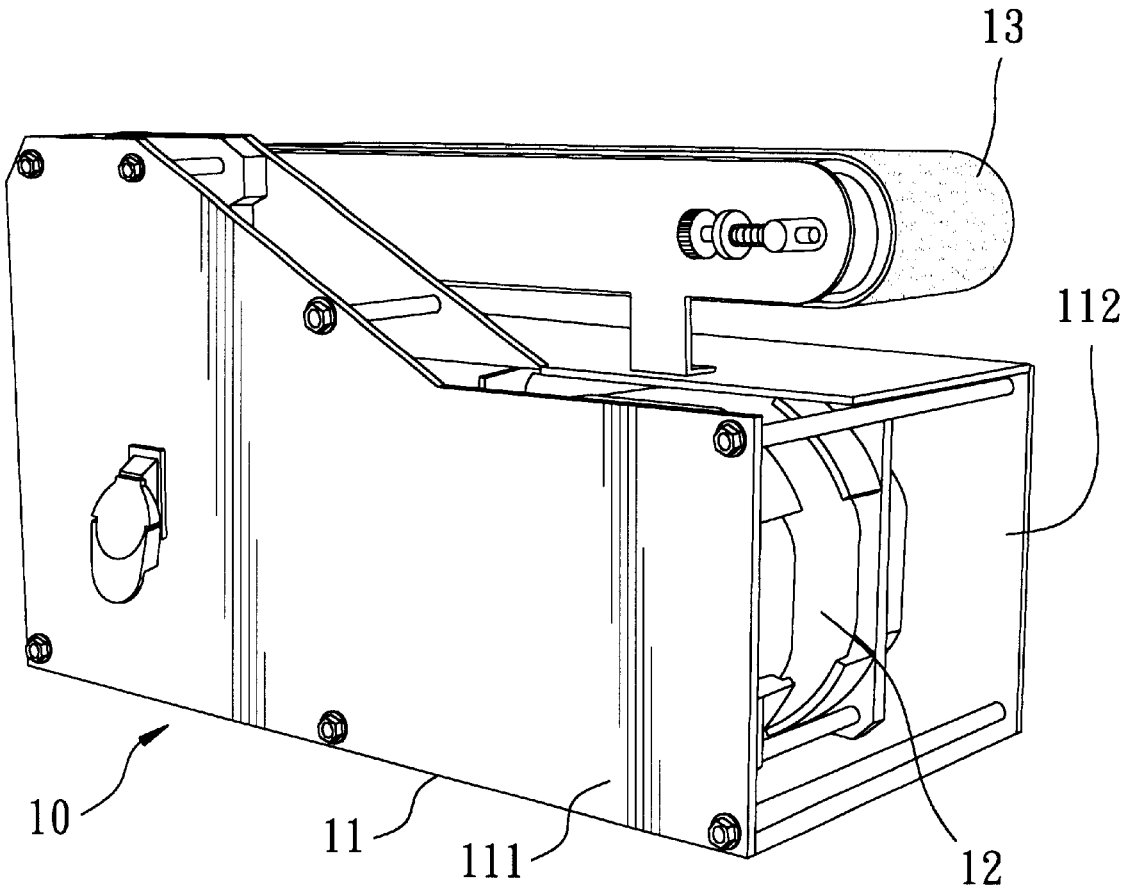
FIG. 1 PRIOR ART
FIG. 1 is a perspective view of a conventional rotary sanding machine.
Figure 2:
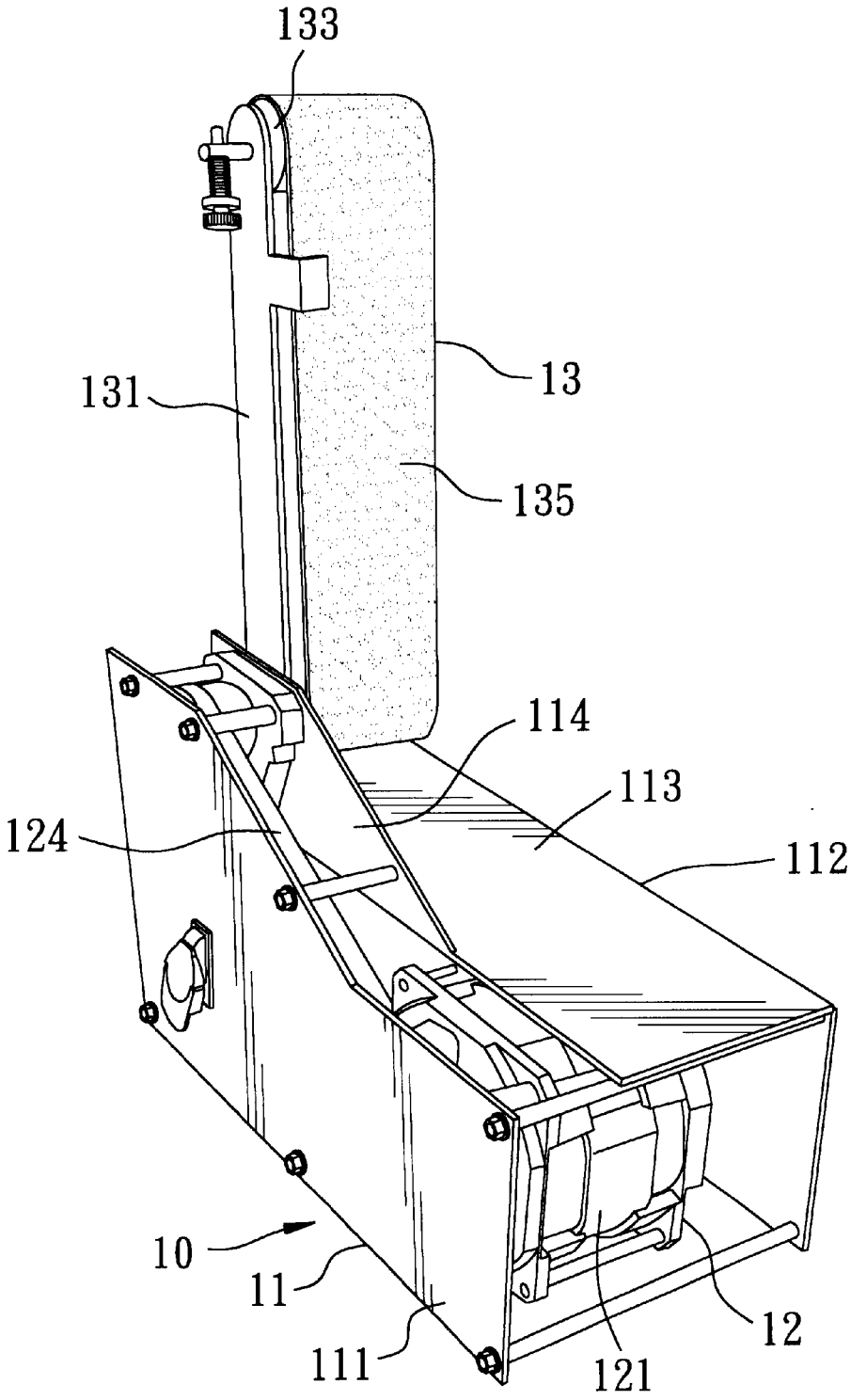
FIG. 2 PRIOR ART
FIG. 2 is a perspective view of the convention rotary sanding machine viewed from another angle.
Figure 3:
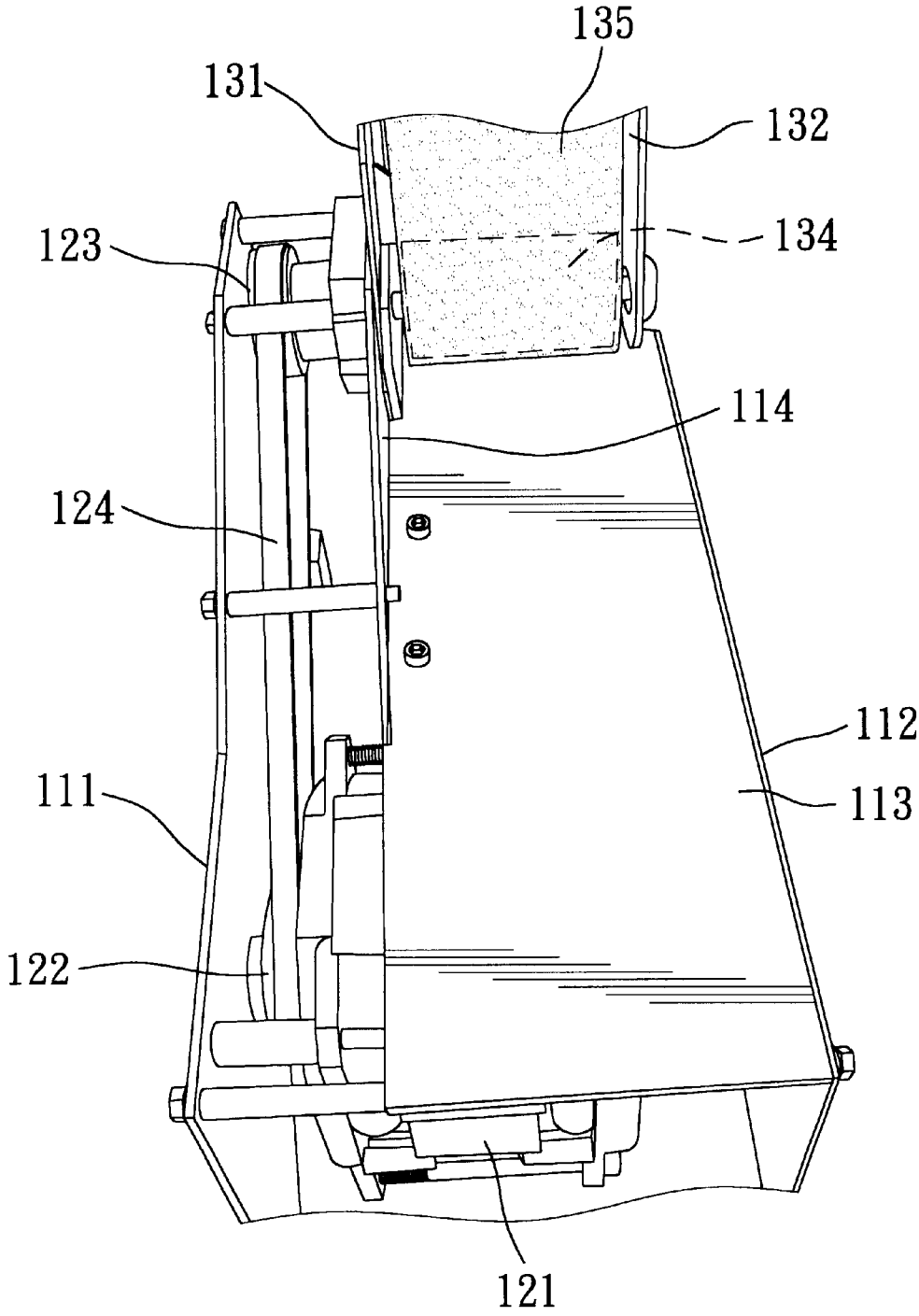
FIG. 3 PRIOR ART
FIG. 3 is a fragmentary perspective view of the conventional rotary sanding machine viewed from a top side thereof.
Figure 4:
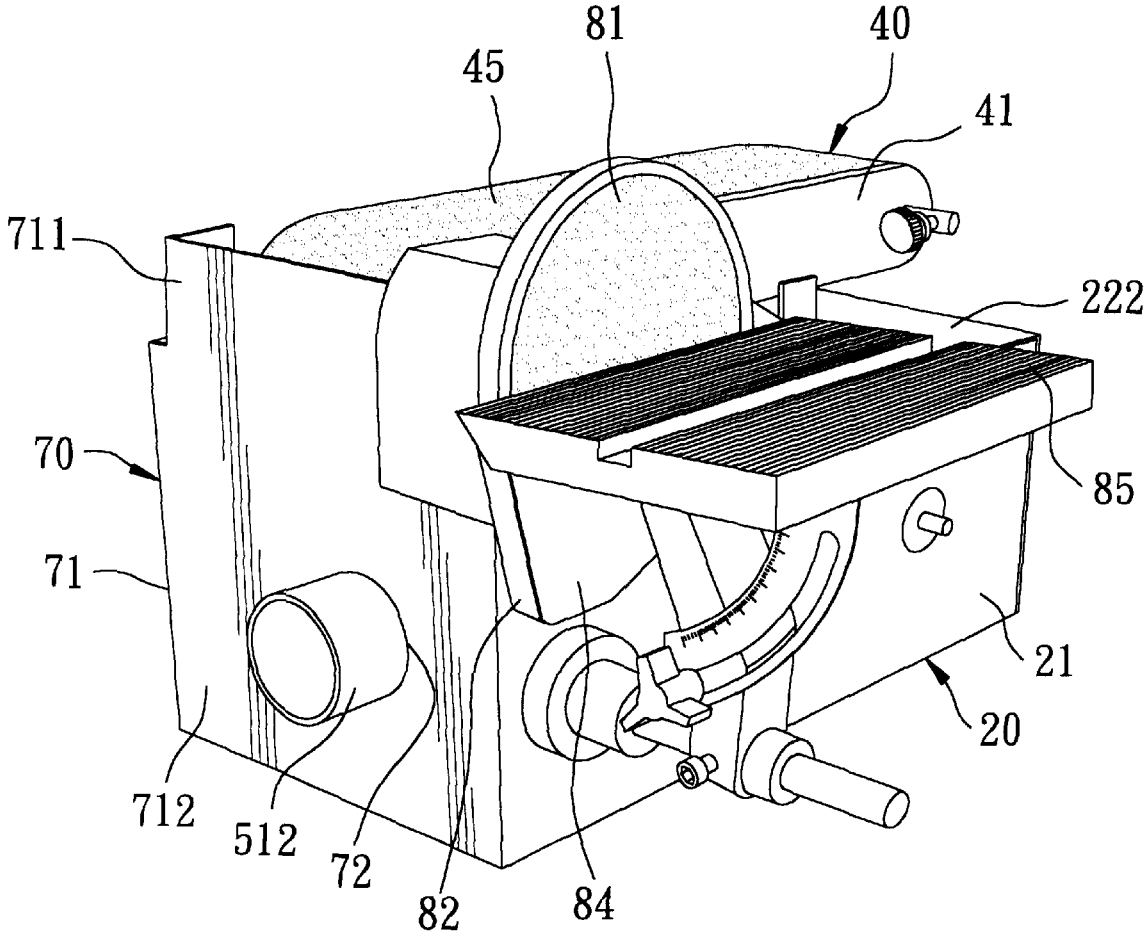
FIG. 4 is a perspective view of a preferred embodiment of a rotary sanding machine according to this invention.
Figure 5:
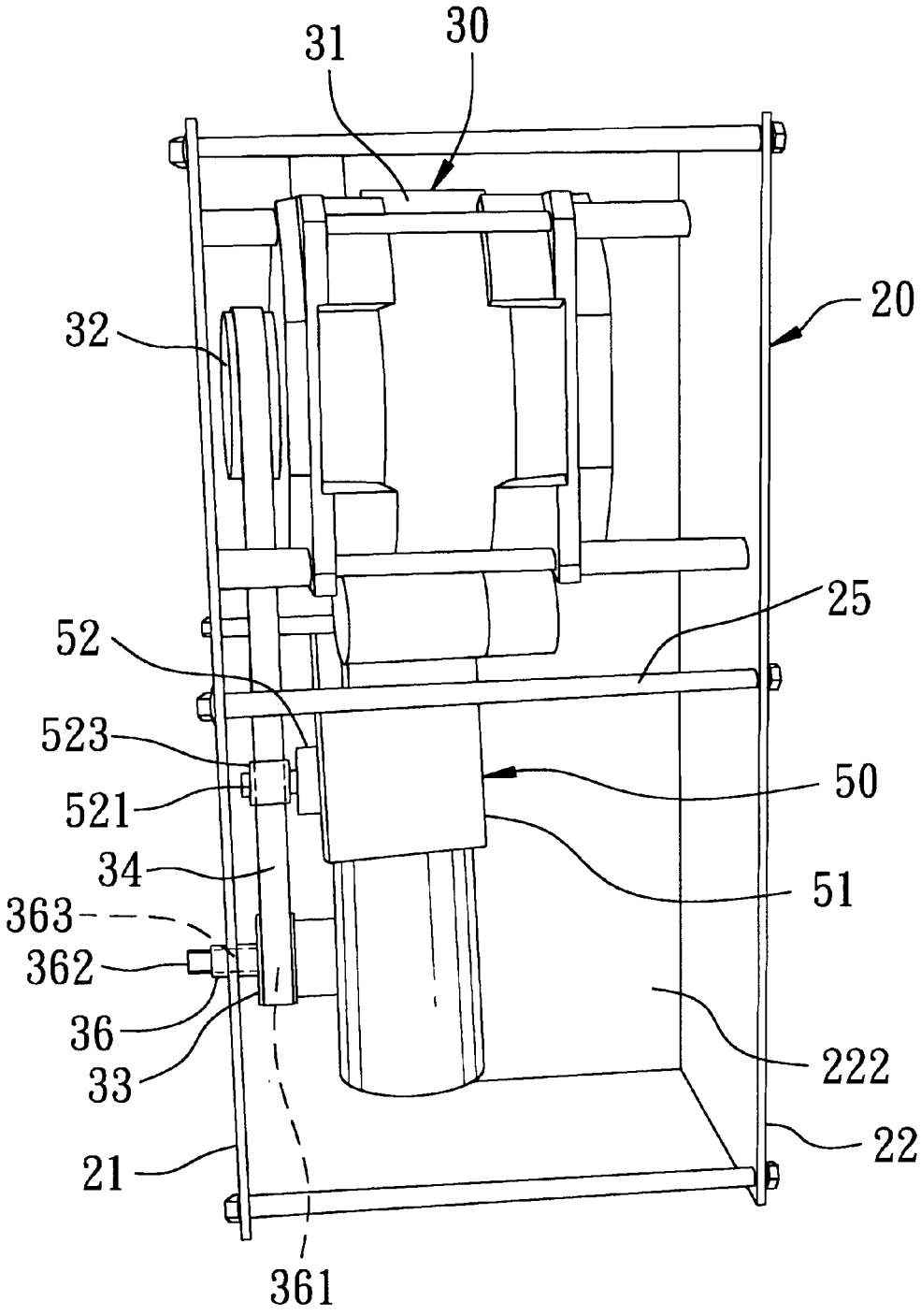
FIG. 5 is a fragmentary perspective view of the preferred embodiment viewed from a bottom side thereof.
Figure 6:
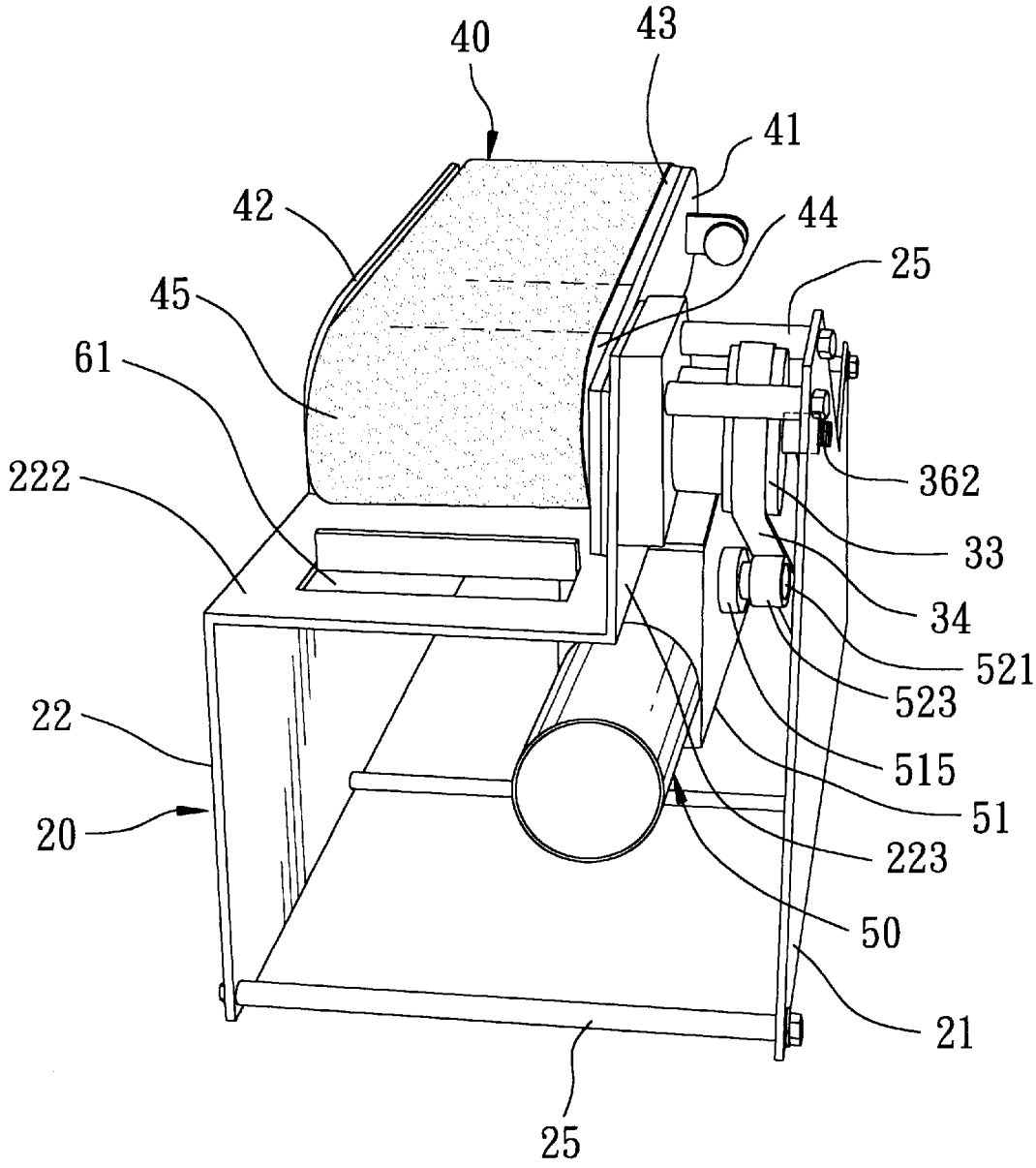
FIG. 6 is a fragmentary perspective view of the preferred embodiment, where a dust collecting member and a barrier member are removed for the sake of clarity.

Referring to FIGS. 4 to 6, the preferred embodiment of a rotary sanding machine according to the present invention is shown to comprise a support frame 20, a power unit 30, a sanding member 40, and a dust collecting mechanism.

The support frame 20 has right and left frame walls 21,22 which are secured opposite to each other in a longitudinal direction by means of fasteners 25 to confine a receiving space, a mounting wall 222 which is disposed between the frame walls 21,22 and which extends in the longitudinal direction, and an upright wall 223 which extends upwardly from the mounting wall 222. The mounting wall 222 has a through hole 61 which extends therethrough in an upright direction.

The power unit 30 includes a motor 31 with an output shaft to deliver a drive force, and an endless drive transmission member. The transmission member includes a driving pulley 32 which is coupled to and which is rotated by the output shaft of the motor 31, a driven pulley 33 which is rotatable about a first axis in the longitudinal direction, and an endless belt 34 which is trained on the driving and driven pulleys 32,33 and which runs along a transmission route. A transmission shaft 36 extends along the first axis, and is coupled to the driven pulley 33 so as to be driven to rotate about the first axis when the motor 31 is operated. The transmission shaft 36 has a first transmission shaft end 361 which is disposed between the right frame wall 21 and the upright wall 223, a second transmission shaft end 362 which is disposed on and which projects outwardly of the right frame wall 21, and a middle transmission shaft portion 363 which is disposed between the first and second transmission shaft ends 361,362.

Figure 12:
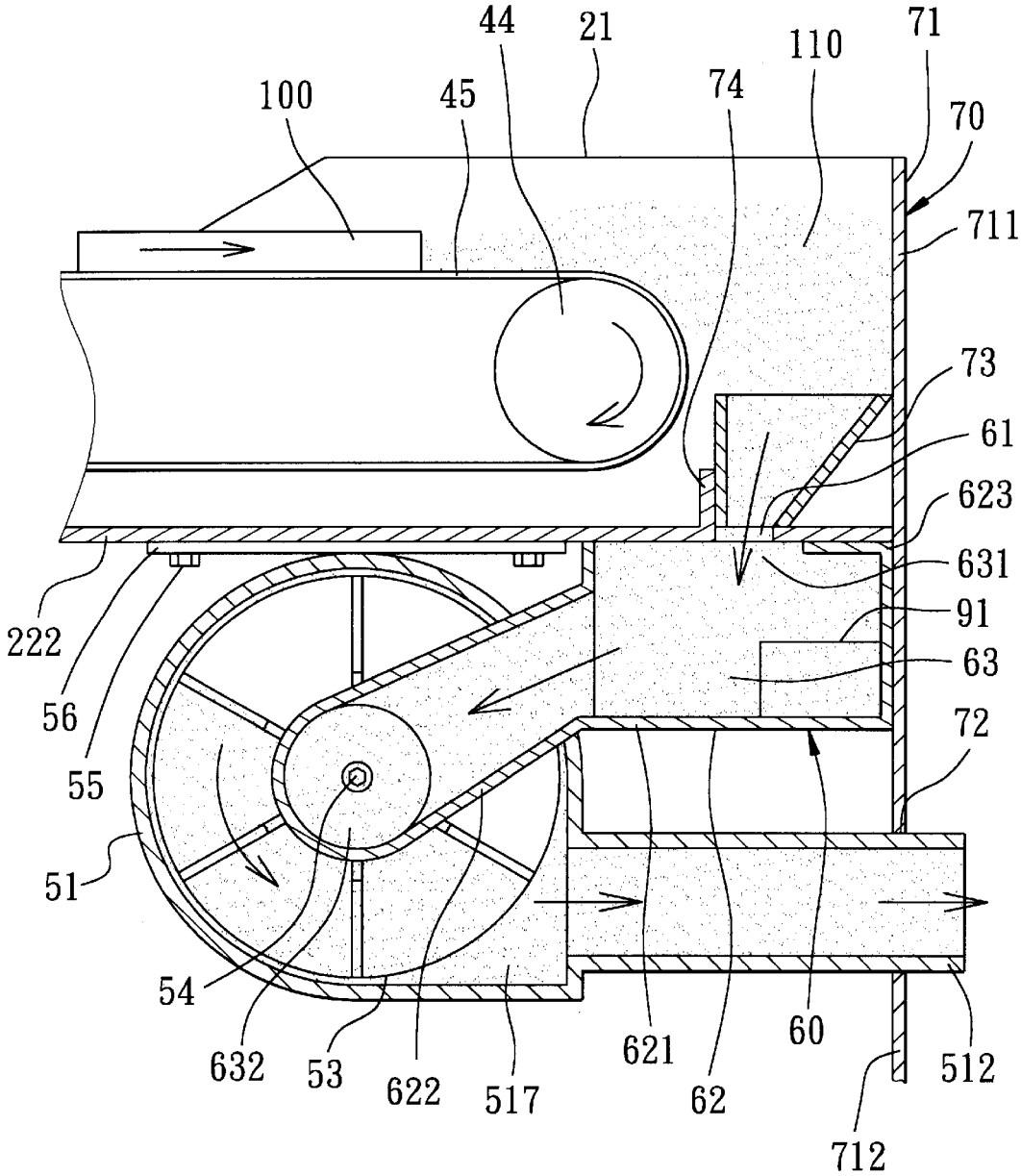
FIG. 12 is a fragmentary sectional view showing the preferred embodiment in a first dust collecting state.

The sanding member 40 includes first and second side plates 41,42 which are secured on the mounting wall 222, a driven wheel 44 which is mounted between the first and second side plates 41,42 and which is spaced apart from the through hole 61 in a transverse direction relative to the upright and longitudinal directions, a follower wheel 43 which is opposite to the driven wheel 44 in the transverse direction to define an upper path for passage of a workpiece 100 (as shown in FIG. 12), and an emery coated belt 45 which is trained on the driven and follower wheels 44,43. The driven wheel 44 is coupled to and is rotated by the first transmission shaft end 361 of the transmission shaft 36. The emery coated belt 45 has a working segment running through the upper path for sanding the workpiece.

The dust collecting mechanism includes a barrier member 70, a dust collecting member 60, and a blower member 50.

Figure 9:
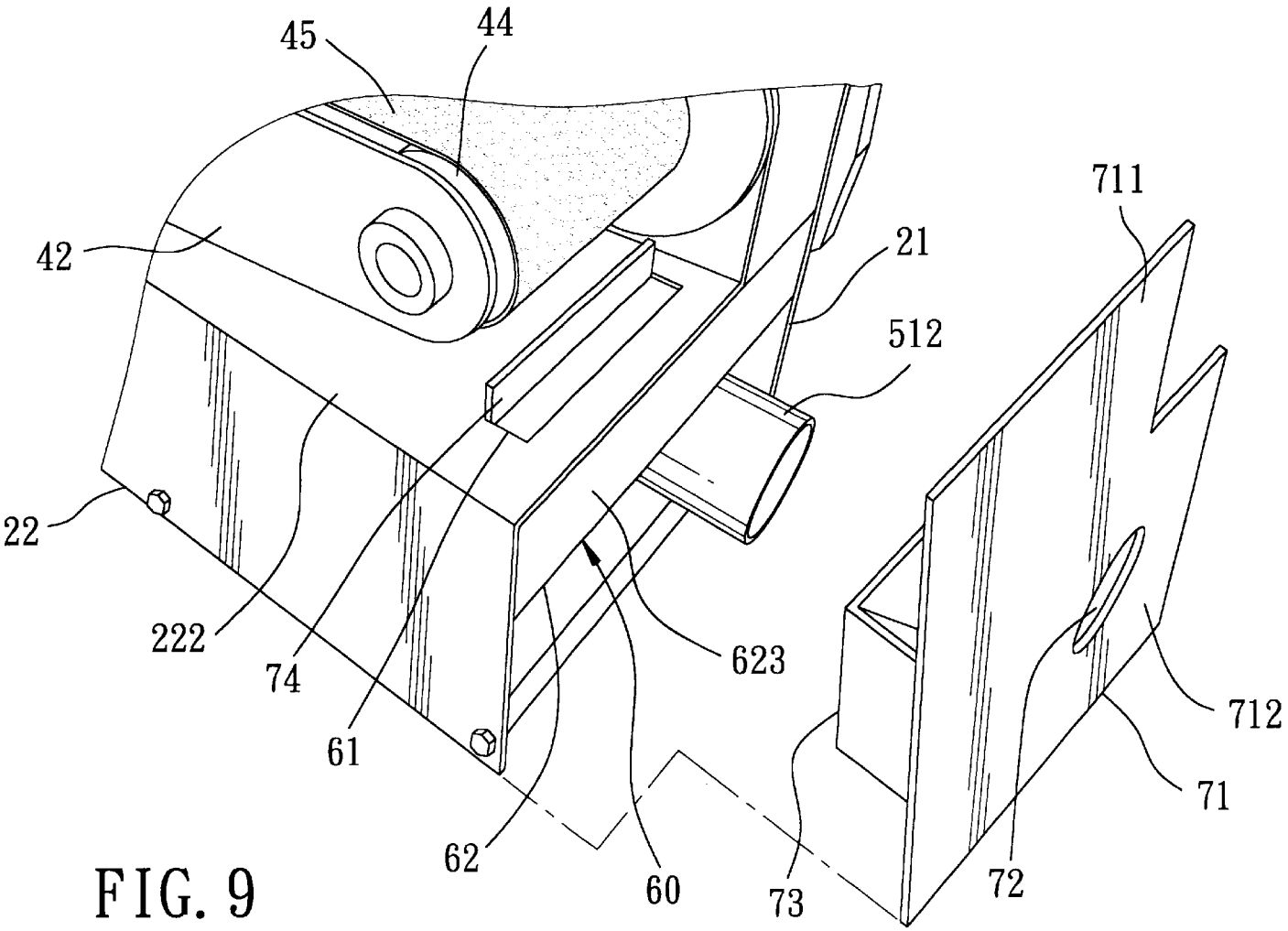
FIG. 9 is a fragmentary exploded perspective view showing relative position of the barrier member and the dust collecting member.

The barrier member 70 includes a barrier wall 71 which has upper and lower wall portions 711,712 that extend upwardly and downwardly from the mounting wall 222 at a front side thereof. The upper wall portion 711 is disposed opposite to the driven wheel 44 relative to the through hole 61. With reference to FIG. 9, a hopper member 73 is formed on an inner surface of the lower wall portion 712, and surrounds the through hole 61. As such, referring to FIG. 12, dust 110 flying as a result of the sanding action and an abrupt descending movement of the working segment is held back by the barrier wall 71, and falls into the through hole 61 through the hopper member 73. Preferably, a stop block 74 extends upwardly from the mounting wall 222 at the through hole 61 for the hopper member 73 to abut thereagainst.

Figure 7:
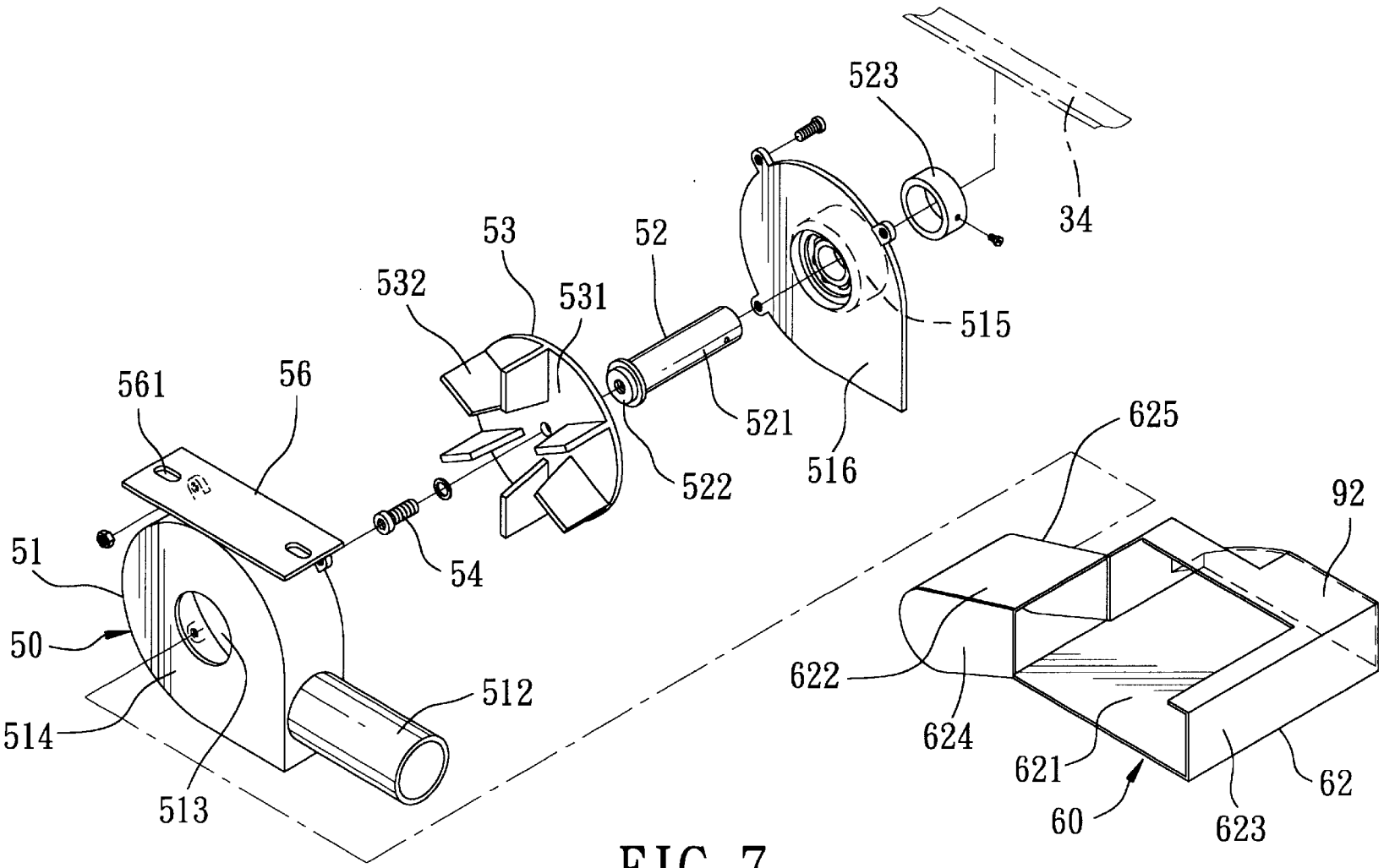
FIG. 7 is an exploded perspective view showing a portion of a dust collecting mechanism of the preferred embodiment.

Referring to FIGS. 7, 9 and 12, the dust collecting member 60 is mounted on the mounting wall 222 and under the through hole 61. The dust collecting member 60 has a collecting seat 62 which includes a bottom plate 621, a dust guiding portion 622 which extends and which is bent upwardly from one side of the bottom plate 621 and which has a closed end 624 and an open end 625, and an abutting wall 623 which extends upwardly from the other side of the bottom plate 621 and which abuts against and which is secured to the mounting wall 222, as shown in FIG. 12. As such, a dust passageway 63 is formed and has an intake port 631 which is disposed in the vicinity of the through hole 61 to collect dust falling through the through hole 61 (see FIG. 12), and an outlet port 632 at the open end 625 of the dust guiding portion 622 (see FIG. 13).

Referring to FIGS. 6 to 8 and FIGS. 12 and 13, the blower member 50 includes a blower casing 51, an impeller driving shaft 52, and an impeller 53.

The blower casing 51 is mounted under the mounting wall 222, and has proximate and distal walls 514,516 opposite to each other in the longitudinal direction to confine a casing space 517. The proximate wall 514 confronts the open end 625 of the dust guiding portion 622, and has an inlet port 513 which is in fluid communication with the outlet port 632 (see FIG. 13). A discharge port 512 is disposed between the proximate and distal walls 514,516, is in fluid communication with the casing space 517, and extends outwardly of the lower wall portion 712 through a hole 72.

The impeller driving shaft 52 is mounted rotatably on the distal wall 516 through a bearing seat 515 about a second axis parallel to the first axis of the driven pulley 33 (see FIG. 5), and has a first end 522 which extends into the casing space 517, and a second end 521 which extends from the first end 522 and outwardly of the bearing seat 515. Preferably, referring to FIGS. 5, 13 and 14, the second end 521 is provided with a driven wheel 523. The driven wheel 523 is held against the belt 34 to a position where a dynamic friction is generated therebetween, such that the driven wheel 523 can be rotated about the second axis.

The impeller 53 is received in the casing space 517, and includes a connecting plate 531 which is connected to the first end 522 of the impeller driving shaft 52 by means of a screw fastener 54 to rotate about the second axis, and a plurality of fins 532 which are formed on the connecting plate 531.

Figure 8:
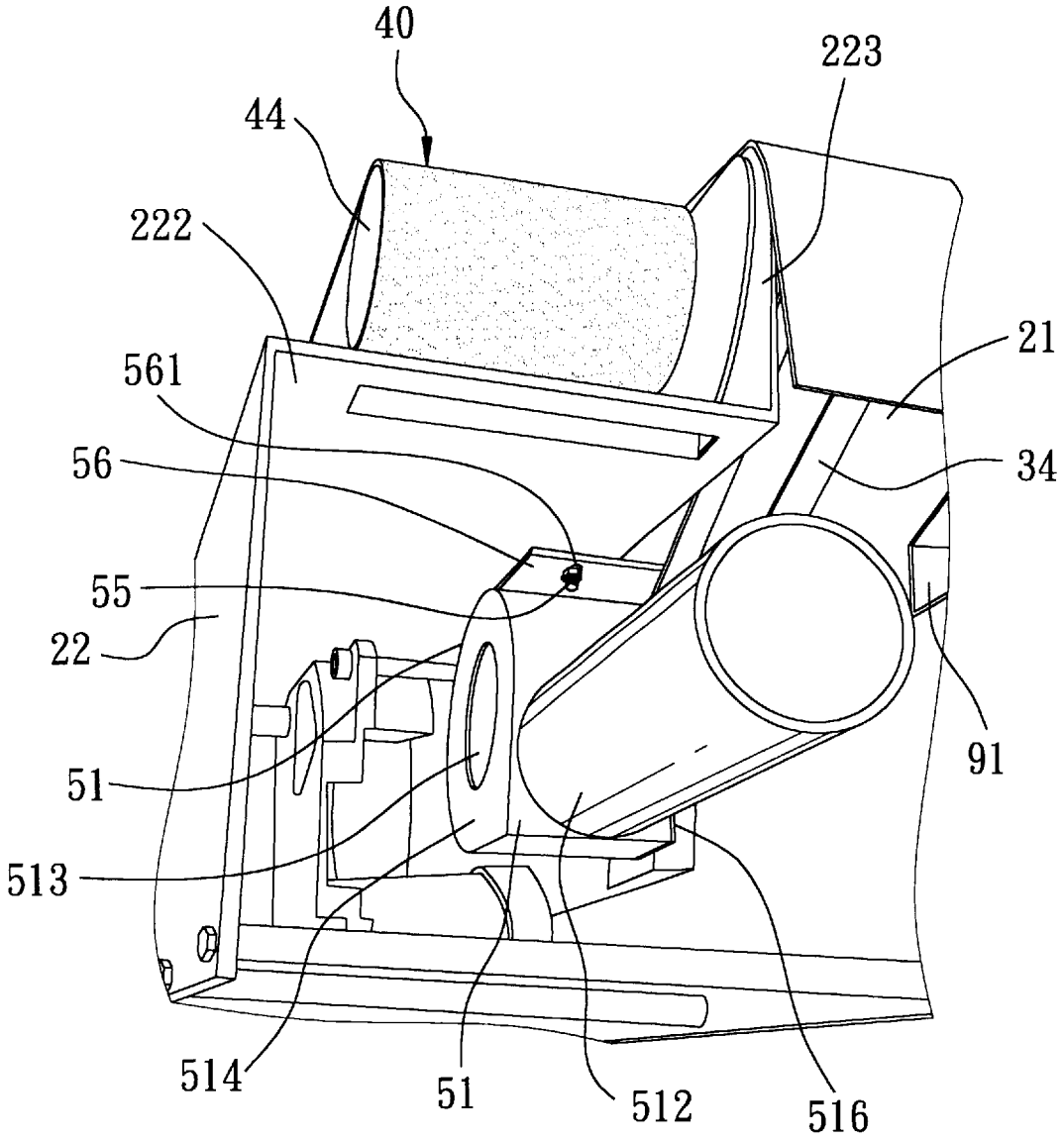
FIG. 8 is a fragmentary perspective view showing the dust collecting mechanism when mounted on a support frame.

Preferably, referring to FIGS. 6, 7 and 8, an adjusting member includes a positioning plate 56 which is disposed on the blower casing 51 and which has two elongate holes 561 formed therein. Two screw fasteners 55 pass through the elongate holes 561 and threadedly engage the mounting wall 222 so as to secure the blower casing 51 to the mounting wall 222. As such, a distance between the driven wheel 523 and the driven pulley 33 is adjustable by displacement of the screw fasteners 55 along the elongate holes 561, thereby adjusting tension of the belt 34.

Figure 10:
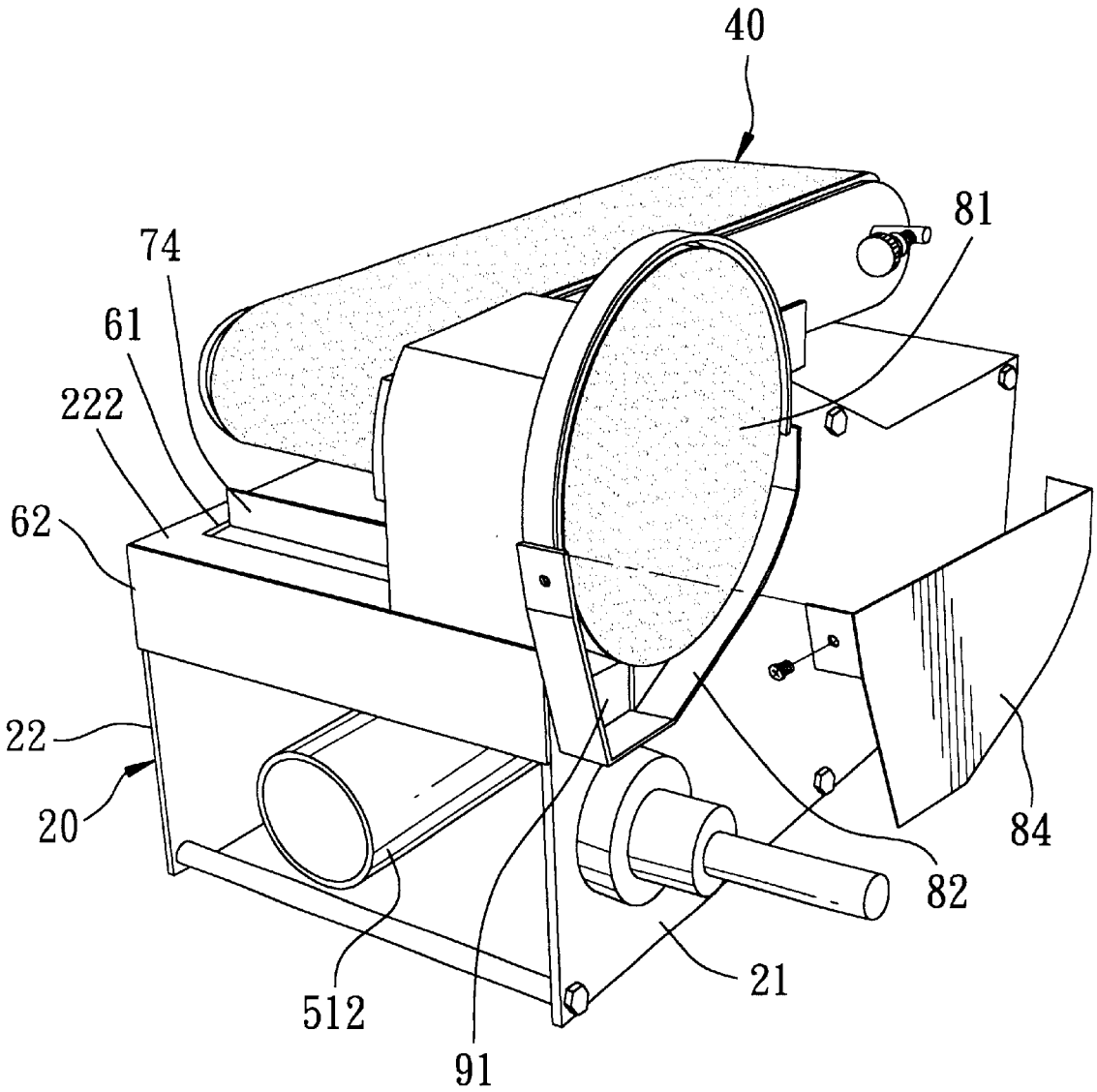
FIG. 10 is a fragmentary exploded perspective view of the preferred embodiment.
Figure 11:
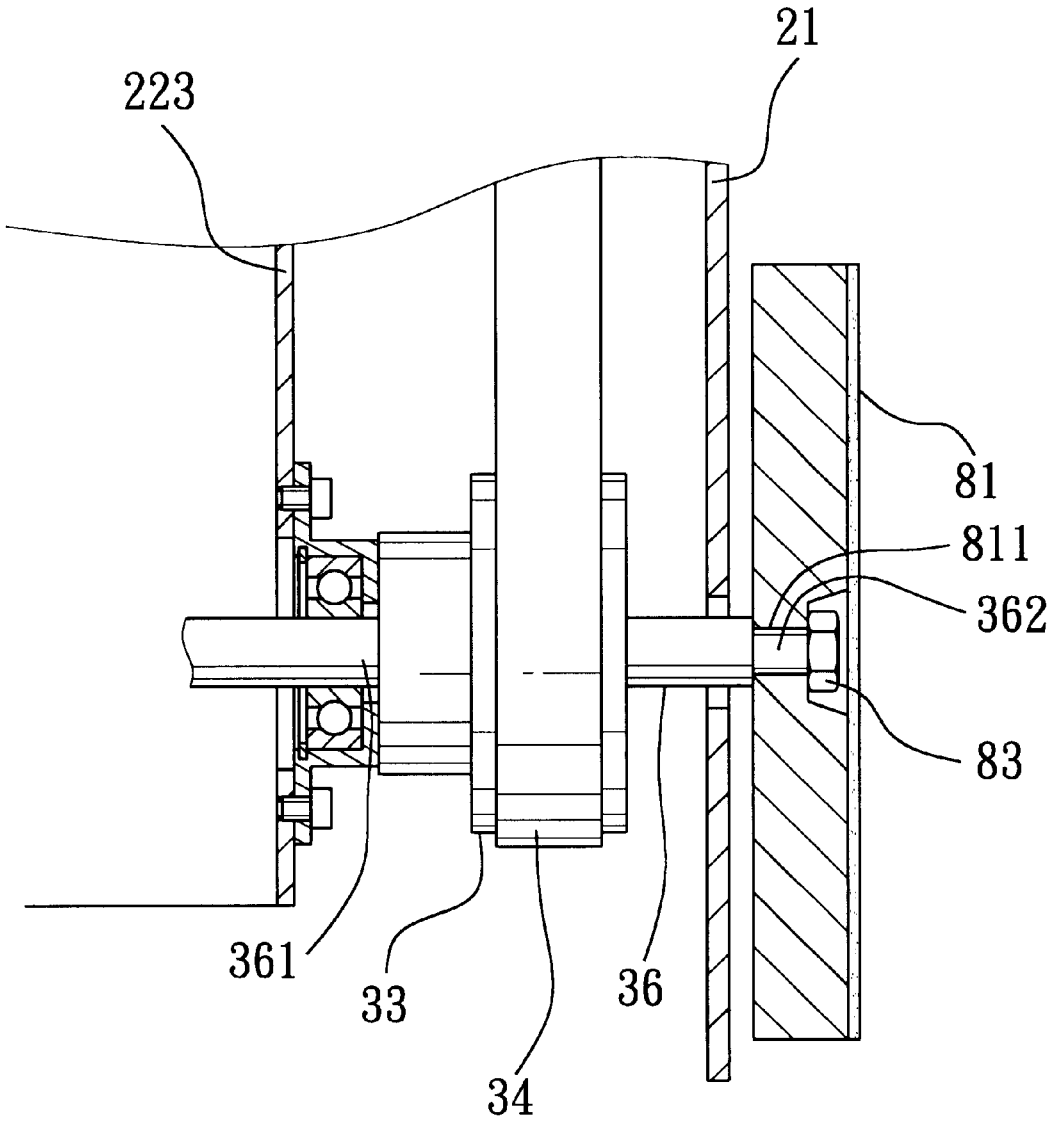
FIG. 11 is a fragmentary sectional view showing an emery wheel of the preferred embodiment when mounted on the support frame.
Figure 13:
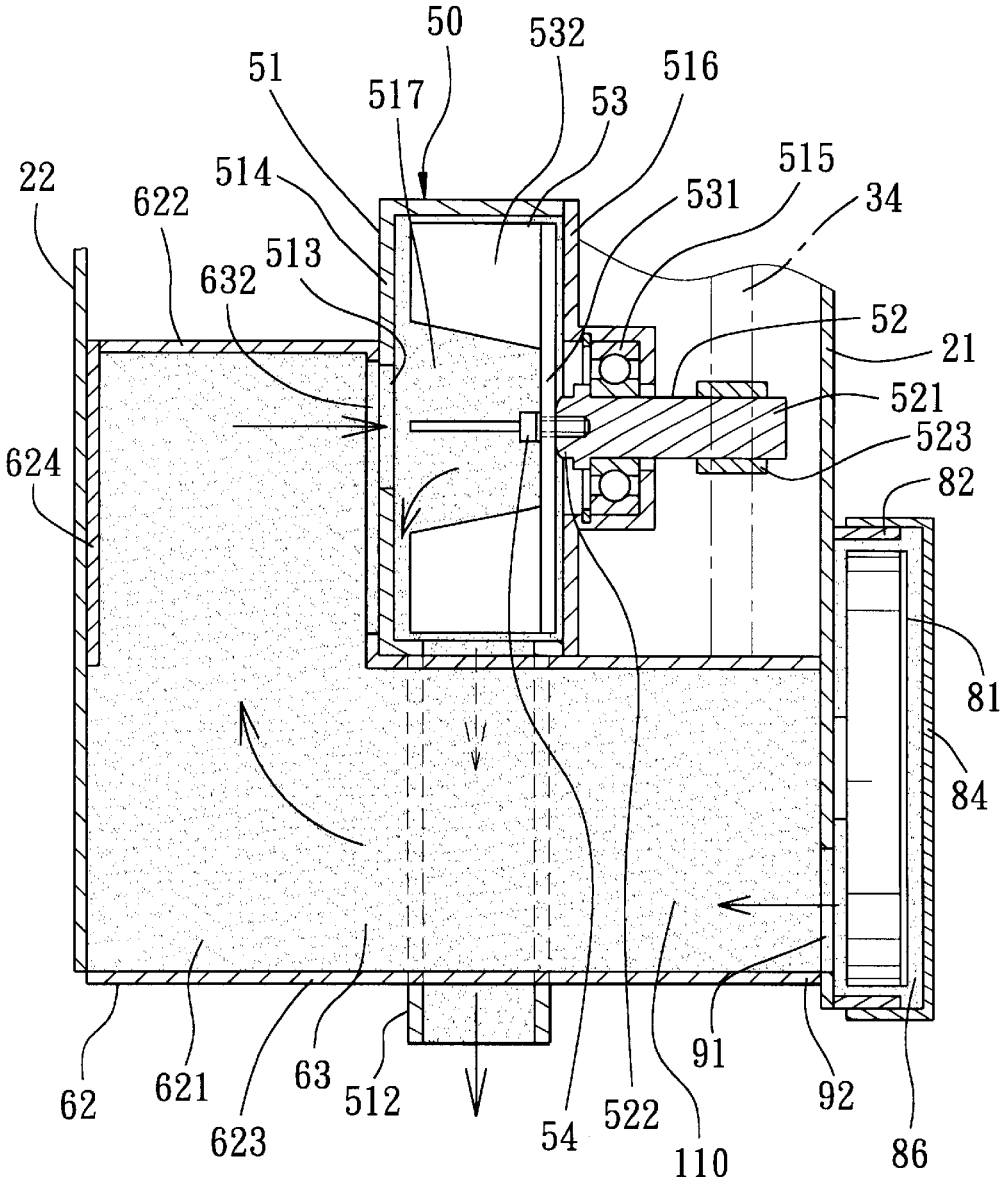
FIG. 13 is a fragmentary sectional view showing the preferred embodiment in a second dust collecting state.
Figure 14:
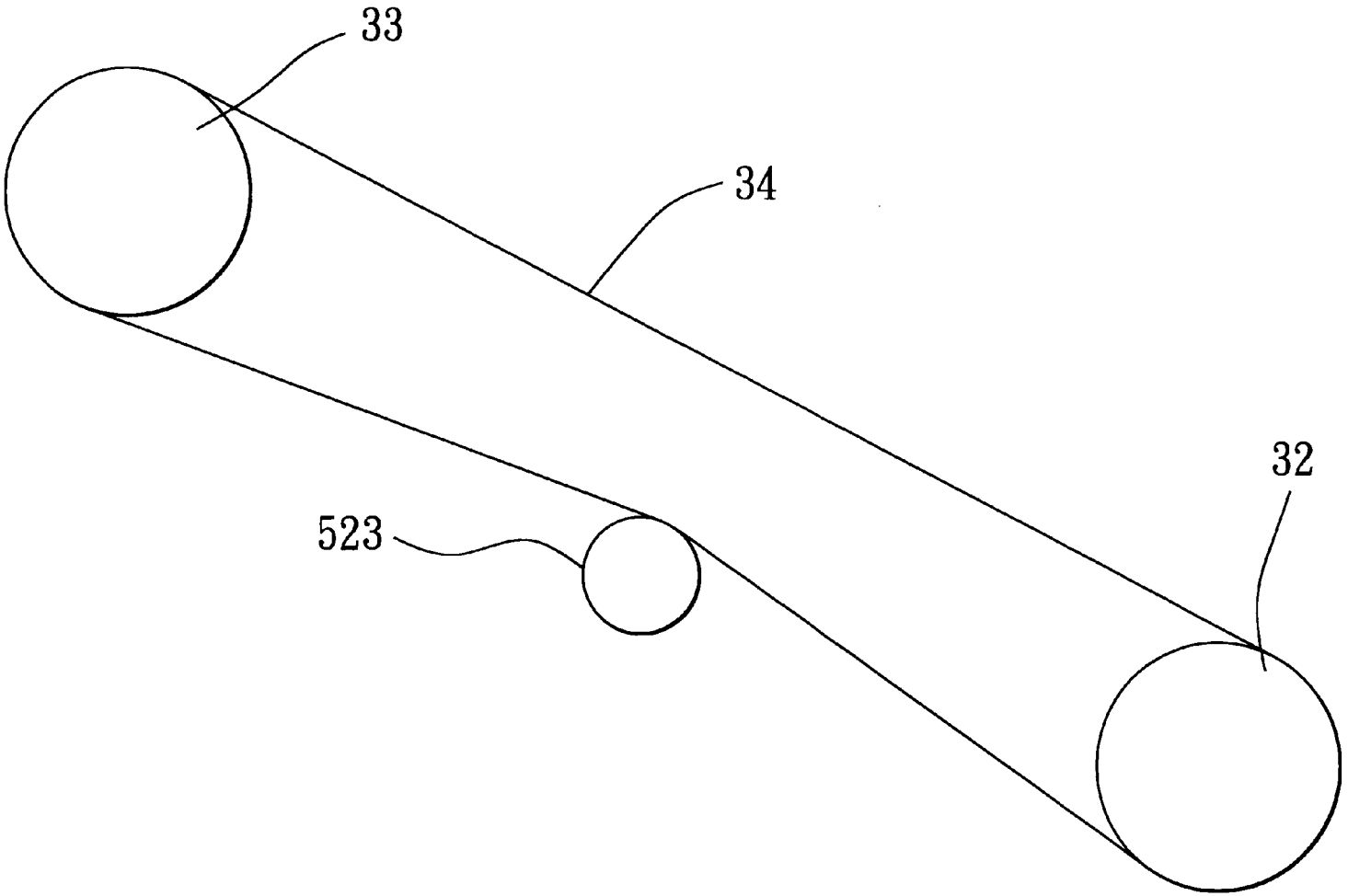
FIG. 14 is a schematic view showing a driven wheel when held against an endless belt of the preferred embodiment.

Preferably, as shown in FIGS. 4, 10 and 11, an emery wheel 81 is mounted for rotation with the second transmission shaft end 362 of the transmission shaft 36 by a thread segment of the second transmission shaft end 362 that engages a hole 811 in the emery wheel 81 and a screw nut 83, and is disposed outboard to the right frame wall 21. A worktable 85 is mounted outboard to the emery wheel 81 for supporting a workpiece (not shown). A dust chute 82 is disposed in the vicinity of the emery wheel 81, and is covered by a cover plate 84 so as to confine a dust collecting space 86 that covers a lower portion of the emery wheel 81. With reference to FIGS. 7 and 13, the dust chute 82 has a communicating port 91 which is formed in the right frame wall 21 and which is disposed upstream of a communicating port 92 of the dust collecting member 60 so as to communicate the dust collecting space 86 with the dust passageway 63.

As illustrated, referring to FIGS. 4, 5 and 12, when the workpiece 100 is placed on the upper path of the emery coated belt 45, and is forced forwardly toward the driven wheel 44, and when the motor 31 is operated, both the transmission shaft 36 and the impeller driving shaft 52 will be rotated about the first and second axes, respectively, so as to rotate respectively the driven wheel 44 and the impeller 53. Dust 110 flying as a result of the sanding action of the belt 45 is held back by the barrier wall 71, falls into the dust passageway 63 through the hopper member 73 and the through hole 61, and is drawn from the dust passageway 63 into the casing space 517 for discharge through the discharge port 512.

On the other hand, as shown in FIG. 13, dust 110 flying as a result of the sanding action of the emery wheel 81 falls into the dust collecting space 86 in the dust chute 82, and is drawn from the dust collecting space 86 into the casing space 517 through the communicating ports 91,92, the dust passageway 63 and the inlet port 513 for discharge through the discharge port 512.

By virtue of the aforesaid construction, the rotary sanding machine of this invention can achieve the following advantages:

1. Dust 110 during sanding actions of the emery coated belt 45 and the emery wheel 81 can be collected and discharged through the discharge port 512. Preferably, a dust bag (not shown) is connected to the discharge port 512, thereby resulting in convenient disposal of the collected dust.

2. The transmission shaft 36 and the impeller driving shaft 52 are driven by the drive transmission member. Therefore, an additional power unit is not required.

3. The rotary sanding machine can include the emery coated belt 45 and the emery wheel 81 for multiple sanding operations. In addition, the emery coated belt 45 and the emery wheel 81 can be driven by the same power unit 30.

4. By virtue of the adjusting member, the tension of the belt 34 is adjustable.

5. By virtue of the cover plate 84, the lower portion of the emery wheel 81 is shielded to enhance safety during use.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A rotary sanding machine comprising:

a support frame having right and left frame walls opposite to each other in a longitudinal direction to confine a receiving space, and a mounting wall disposed between said frame walls and extending in the longitudinal direction, said mounting wall having a through hole which extends therethrough in an upright direction;

a motor having an output shaft to deliver a drive force;

a transmission shaft extending along and rotatable about a first axis in the longitudinal direction, and driven by the drive force of said output shaft, said transmission shaft having a first transmission shaft end which is disposed above said mounting wall, a second transmission shaft end which is disposed on said right frame wall, and a middle transmission shaft portion which is disposed between said first and second transmission shaft ends;

a sanding member including a driven wheel which is mounted above said mounting wall, which is spaced apart from said through hole in a transverse direction relative to the upright and longitudinal directions, and which is coupled to and rotated by said first transmission shaft end, a follower wheel opposite to said driven wheel in the transverse direction to define an upper path for passage of a workpiece, and an emery coated belt which is trained on said driven and follower wheels, said emery coated belt having a working segment running through said upper path for sanding the workpiece;

a barrier wall extending upwardly from said mounting wall, and disposed opposite to said driven wheel relative to said through hole to hold back dust flying as a result of the sanding action and an abrupt descending movement of said working segment so as to permit the dust to fall into said through hole;

a dust collecting member mounted on said mounting wall and under said through hole, said dust collecting member having a dust passageway which has an intake port that is disposed in the vicinity of said through hole to collect dust falling through said through hole, and an outlet port;

a blower casing disposed in said receiving space, and having proximate and distal walls opposite to each other in the longitudinal direction and respectively proximate to and distal from said outlet port of said dust passageway to confine a casing space, and a discharge port which is disposed between said proximate and distal walls and which is in fluid communication with said casing space, said proximate wall having an inlet port which is connected to said outlet port so as to communicate said dust passageway with said casing space;

an impeller driving shaft mounted rotatably on said distal wall about a second axis parallel to the first axis, and having a first end which extends into said casing space, and a second end which extends from said first end and outwardly of said distal wall;

an endless drive transmission member disposed to transmit the drive force of said output shaft to rotate both said transmission shaft about the first axis, and said second end of said impeller driving shaft, thereby rotating said impeller driving shaft about the second axis when said motor is operated; and an impeller received in said casing space, and driven by said first end of said impeller driving shaft to rotate about the second axis so as to draw the dust from said dust passageway into said casing space for discharge through said discharge port.

2. The rotary sanding machine of claim 1, wherein said endless drive transmission member includes a driving pulley which is coupled to and which is rotated by said output shaft, a driven pulley which is coupled to said transmission shaft, and an endless belt which is trained on said driving and driven pulleys and which runs along a transmission route, and wherein said second end of said impeller driving shaft is provided with a driven wheel which is held against said endless belt to a position where a dynamic friction is generated therebetween, such that said driven wheel is rotated about the second axis.

3. The rotary sanding machine of claim 2, further comprising an emery wheel which is mounted for rotation with said second transmission shaft end of said transmission shaft, and which is disposed outboard to said right frame wall, and a dust chute which is disposed in the vicinity of said emery wheel, and which has a communicating port that is disposed downstream of said emery wheel and upstream of said dust passageway of said dust collecting member such that dust as a result of sanding action of said emery wheel is guided from said dust chute into said dust passageway.

4. The rotary sanding machine of claim 2, further comprising an adjusting member which is disposed to adjust distance between said driven wheel and said driven pulley, thereby adjusting tension of said endless belt.

5. The rotary sanding machine of claim 1, further comprising a hopper member which is disposed on said mounting wall and which surrounds said through hole for guiding the dust to fall into said through hole.

* * * * *